US006571693B1

(12) United States Patent
Kaldenberg et al.

(10) Patent No.: US 6,571,693 B1
(45) Date of Patent: Jun. 3, 2003

(54) VEHICLE RECYCLING SYSTEM AND METHOD

(75) Inventors: James A. Kaldenberg, Albia, IA (US); Norman Wellings, Oskaloosa, IA (US)

(73) Assignee: Al-Jon, Ottumwa, IA (US)

( * ) Notice: Subject to any disclaimer, the term of this patent is extended or adjusted under 35 U.S.C. 154(b) by 53 days.

(21) Appl. No.: 09/684,151

(22) Filed: Oct. 6, 2000

Related U.S. Application Data

(60) Provisional application No. 60/157,993, filed on Oct. 6, 1999.

(51) Int. Cl.[7] ..... B30B 9/00; B30B 15/30

(52) U.S. Cl. ..... 100/95; 100/215; 100/218; 100/229 R; 100/901

(58) Field of Search ..... 100/901, 224, 100/902, 95, 229 R, 215, 218; 414/222.01

(56) References Cited

U.S. PATENT DOCUMENTS

| | | | | |
|---|---|---|---|---|
| 3,685,128 A | | 8/1972 | Sharp et al. | 100/100 |
| 3,762,321 A | * | 10/1973 | Patros | 100/215 |
| 4,554,868 A | * | 11/1985 | Zimmer | 100/229 R |
| 5,044,569 A | * | 9/1991 | LaBounty et al. | 225/103 |
| 5,577,873 A | * | 11/1996 | Tanaka et al. | 414/280 |
| 5,667,079 A | * | 9/1997 | Jongebloed | 209/589 |
| 5,782,176 A | | 7/1998 | Bevan | 29/403 |

OTHER PUBLICATIONS

Al–jon, Inc.—ELV Systems, 1998.*

* cited by examiner

*Primary Examiner*—Allen Ostrager
*Assistant Examiner*—Jimmy T Nguyen
(74) *Attorney, Agent, or Firm*—McAndrews, Held & Malloy, Ltd.

(57) ABSTRACT

A vehicle recycling system includes an hold-down mechanism, a crane having an engine puller, a component disassembly station, a feed press, and a material press, all of which are housed within a building. A vehicle is placed onto a hold-down table where it is held in place by the hold-down mechanism while the engine and other valuable components are removed using the crane. Components not requiring further processing are placed into bins. Components requiring further disassembly are fed to the component disassembly where they are further disassembled and placed in bins. Once the high value components are removed, the crane loads the vehicle onto the feed press. The feed press then moves the vehicle onto the material press where it is compressed by the press. The back wall of the press is then raised so the crushed vehicle can be removed.

7 Claims, 19 Drawing Sheets

VEHICLE RECYCLING SYSTEM AND METHOD

CROSS-REFERENCE TO RELATED APPLICATIONS

This application claims priority of Provisional Application Ser. No. 60/157,993 filed Oct. 6, 1999.

STATEMENT REGARDING FEDERALLY SPONSORED RESEARCH OR DEVELOPMENT

Not Applicable.

BACKGROUND OF THE INVENTION

The present invention relates to an improved system and method for recycling scrap vehicles, such as automobiles, and, in particular, to an integrated vehicle recycling system that reduces the amount of space, labor, expense and time required to recycle scrap vehicles and which is capable of be located within a building.

Individual components are known for increasing the efficiency and profitability of recycling junked vehicles. For example, car crushers such as those disclosed in U.S. Pat. No. 3,266,413 to Allen B. Sharp and Richard A. Hull, and U.S. Pat. No. 5,782,176 increase the potential profit available in selling junked vehicles for scrap since their use permits a greater number of vehicles to be hauled per truck load, and thus have reduced the price of hauling junked vehicles to scrap dealers and processor. Similarly, U.S. Pat. No. 3,685,128, issued to Allen B. Sharp and Richard A. Hull, discloses an improved machine and method for removing engines from junked vehicles, thereby reducing the time and labor associated with removing these components from junked vehicles. However, even with these advances there is room for improvement.

In particular, traditional salvage operations are land intensive, requiring on the order of two acres of land. With an ever-dwindling supply of land available for such operations, there is a need to reduce the amount of space required to perform such operations. Additionally, in the past a large portion of the salvage operation has been performed outside. This presents several disadvantages. First, outdoor scrap operations make it difficult to control theft and vandalism. This is especially true of high value components such as copper, aluminum and air bag systems. Outdoor scrap operations also have reduced efficiencies and may even be inoperable during inclement weather. Scrap operations are being subjected to ever-stricter environmental standards, such as edicts of the National Pollution Discharge Elimination System. Outdoor scrap operations have difficulty meeting these standards, especially those relating to controlling run-off and soil contamination. Additionally, traditional salvage operations are typically set up with little or no thought being given to how to optimize the efficiency and/or reducer the labor required to perform the salvage operation.

BRIEF SUMMARY OF THE INVENTION

These and other needs are provided by a vehicle recycling which includes a boom-type crane equipped with an engine pulling mechanism, a hold down mechanism adapted to restrain at least the body portion of the vehicle from while the engine is being removed from the vehicle by the engine pulling mechanism, and a material press for crushing the body of the vehicle after the engine has been removed. The components of the system are preferably mounted on a concrete floor which may be located inside a building.

The hold-down mechanism may be mounted on a hold-down table having a generally horizontal, elongate bed. At least one hold-down beam is movable relative to the bed between a first or open position where the beam does not interfere as vehicles are being loaded onto and off of the table and a second or closed position at which the beam is in contact with the upper surface of the of a vehicle located on the table so as to restrict and restrain the vehicle against movement while the engine is being removed via the engine pulling mechanism. A hydraulic cylinder connected between the bed and the hold-down beam. The cylinder is retractable to move the beam to its open position and extendable to move the beam to its closed position. According to one embodiment, the hold-down is substantially vertical in its open position and substantially horizontal in its closed position. The hold-down beam may be substantially L-shaped and may be pivotally connected to the bed for movement between its open and closed positions. Preferably, the hold-down assembly includes a pair of laterally displaced hold-down beams that are interconnected by transverse members to form an integral assembly. The hold-down beams may carry a plurality of teeth positioned to engage against the top surface of a vehicle located on the hold-down table when the hold-down beam is moved to its closed position. The hold-down table may be divided into a staging are and a hold-down area, both of which are sized to hold a vehicle.

The recycling system may also include a feed press adapted to feed vehicle bodies into the material press following removal of the engine by the engine puller. The a feed press may be interposed between the hold-down table and the material press. The feed press may include a base positioned on the concrete floor and a generally horizontal bed which is sized to receive a vehicle. The bed is mounted for movement relative to the base between a retracted position at which the bed is adjacent to and interposed between the hold-down table and the material press and an extended position at which the feed press bed overlies and is supported from below by the bed of the material press. At least one hydraulic cylinder is provided for moving the bed between its retracted and extended positions.

Alternatively, the feed press may have a stationary bed and pusher plate adapted to move across the bed between a retracted position at which it is laterally displaced from the material press and an extended position at which it is adjacent to the material press. At least one hydraulic cylinder is provided for moving the pusher arm between its extended and retracted position.

The vehicle recycling system may also include a component disassembly where the components such as the engine and transmission are manually separated from each other. During engine removal, the operator maneuvers the boom of the crane to pop the hood of the vehicle and remove desired components from the vehicle, such as its radiator, condenser, engine and transmission. Individual components that do not require further processing, e.g. radiators, are placed into bins located by the hold-down table. Components, such as the engine/transmission assembly, that require further disassembly are fed to the component disassembly station via a conveyor or roller system where they are further disassembled and placed in segregated bins that are located adjacent to the disassembly station. Once the engine and other high value components are from the vehicle, the crane operator loads the vehicle onto the bed of the feed press. The feed press then moves the vehicle onto the bed of the material press where it is compressed by the lid of the material press. After the vehicle has been crushed, the back wall of the press is raised to allow the crushed vehicle to be removed by a material handling vehicle such as a loader.

DETAILED DESCRIPTION OF THE INVENTION

Figure 1:
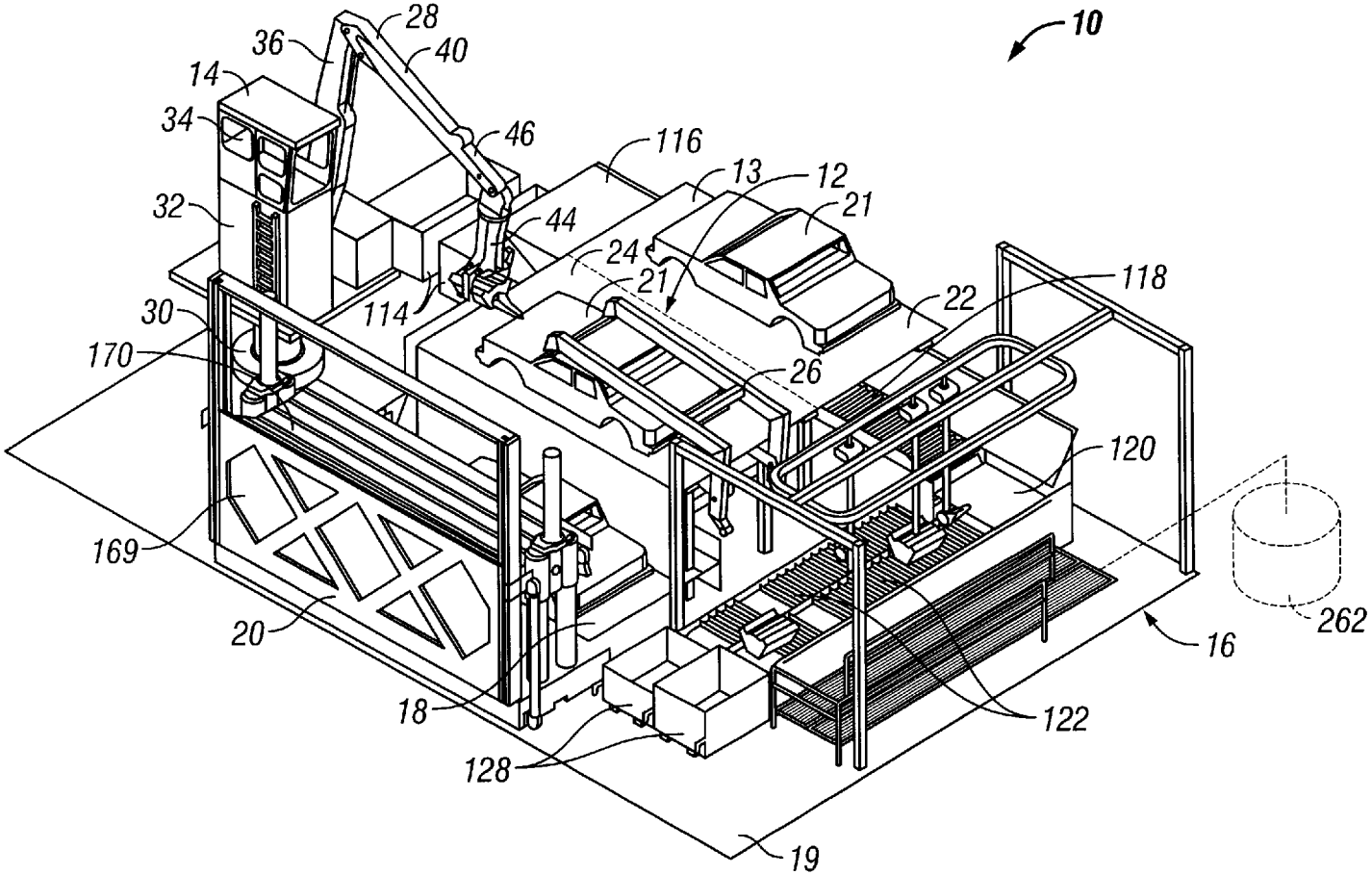
FIG. 1 is a perspective view of a vehicle recycling system according to certain aspects the present invention.

The foregoing summary, as well as the following detailed description of the preferred embodiments of the invention, will be better understood when read in conjunction with the appended drawings. For the purpose of illustrating the invention, there is shown in the drawings embodiments which are present preferred. It should be understood, however, that the present invention is not limited to the precise arrangements and instrumentality shown in the attached drawings. Further, although dimensions are set forth in this patent application, both in the drawings and written description these dimensions are merely exemplary and are not intended to limit the scope of the claimed invention. Except where otherwise indicated, the dimensions reflected in the drawings are in inches.

Figure 6:
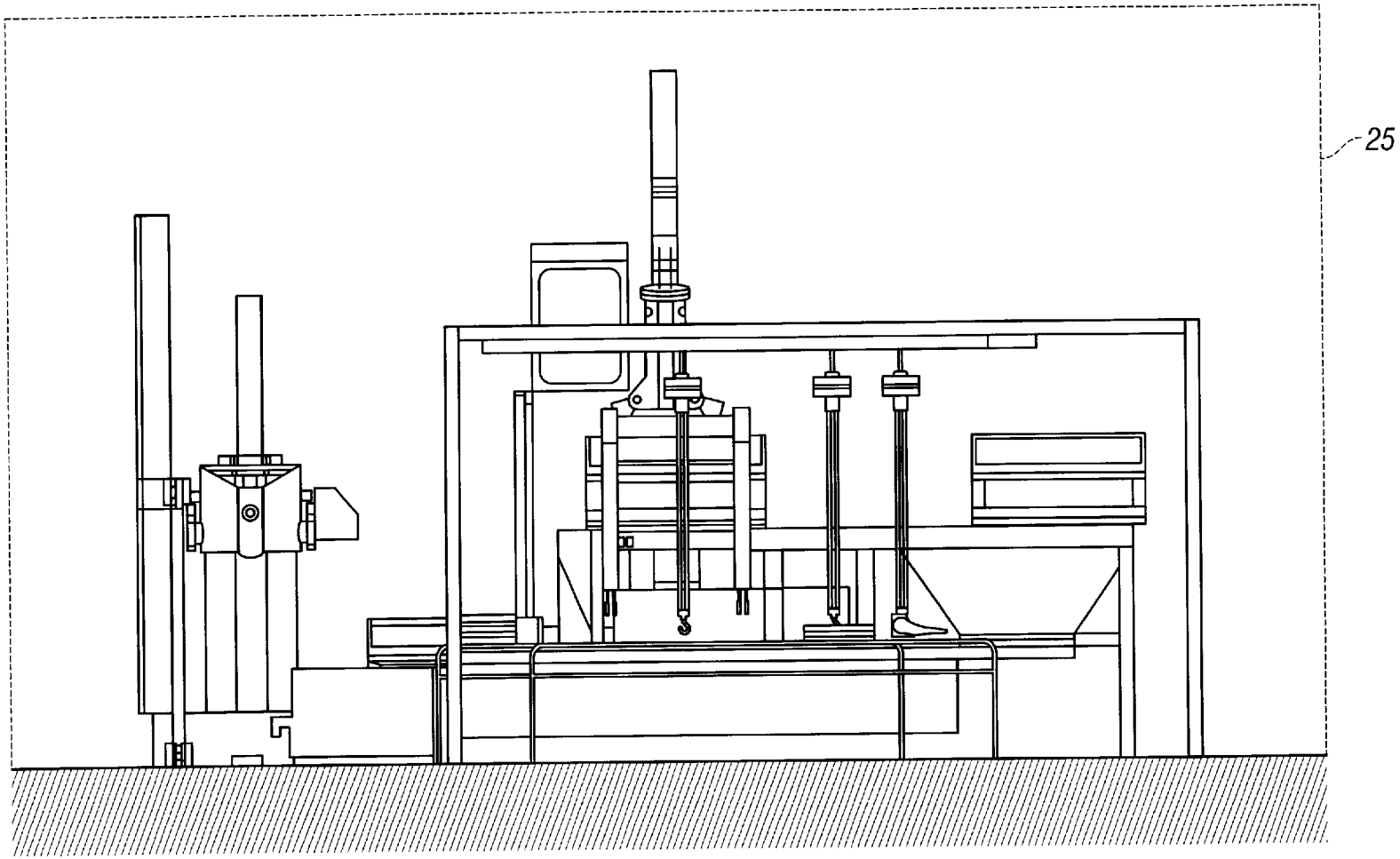
FIG. 6 is an elevation view of the vehicle recycling system of FIG. 1, looking towards the component disassembly area.
Figure 7:
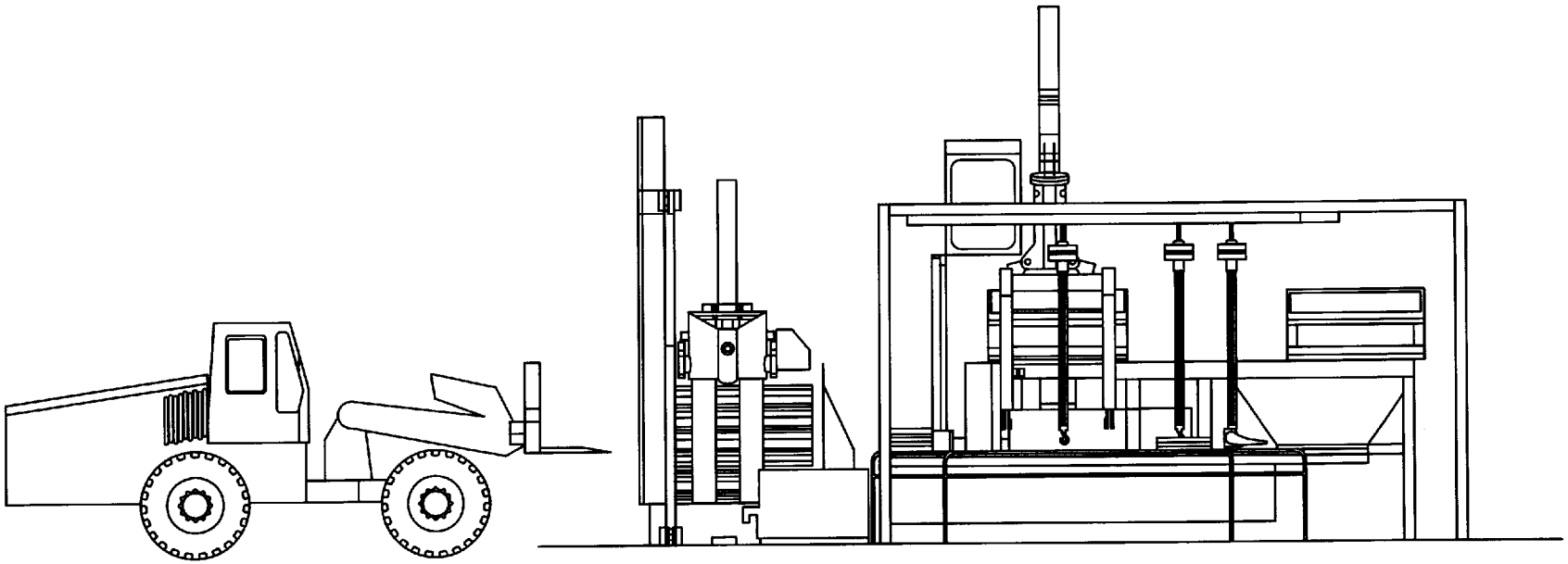
FIG. 7 is an elevation view similar to that of FIG. 6, showing a loader positioned to remove a crushed vehicle from the bed of the material press.

Referring now to the FIGS. 1–16, a vehicle recycling system 10 according to certain aspects of the present invention includes a hold down assembly 12 (consisting of a hold-down table 13 and a hold-down mechanism 26), a material positioner 14 in the form of a crane, a component disassembly area or station 16, a feed press 18, and a material press 20. The various components are preferably mounted on a concrete floor or slab 19, which may be located inside a building (which is illustrated generally as element 25 in FIG. 6). As will be appreciated, when the system is located in a building, the concrete slab will typically extend to the perimeter of the building. Additionally, access doors are preferably provided at several locations, e.g., by the hold-down table, the material press 20, the crane 14, and the disassembly area 16 to allow vehicles (and components) to be easily moved into and out of the system via material handling equipment such as loaders, fork lifts, etc.

Figure 17:
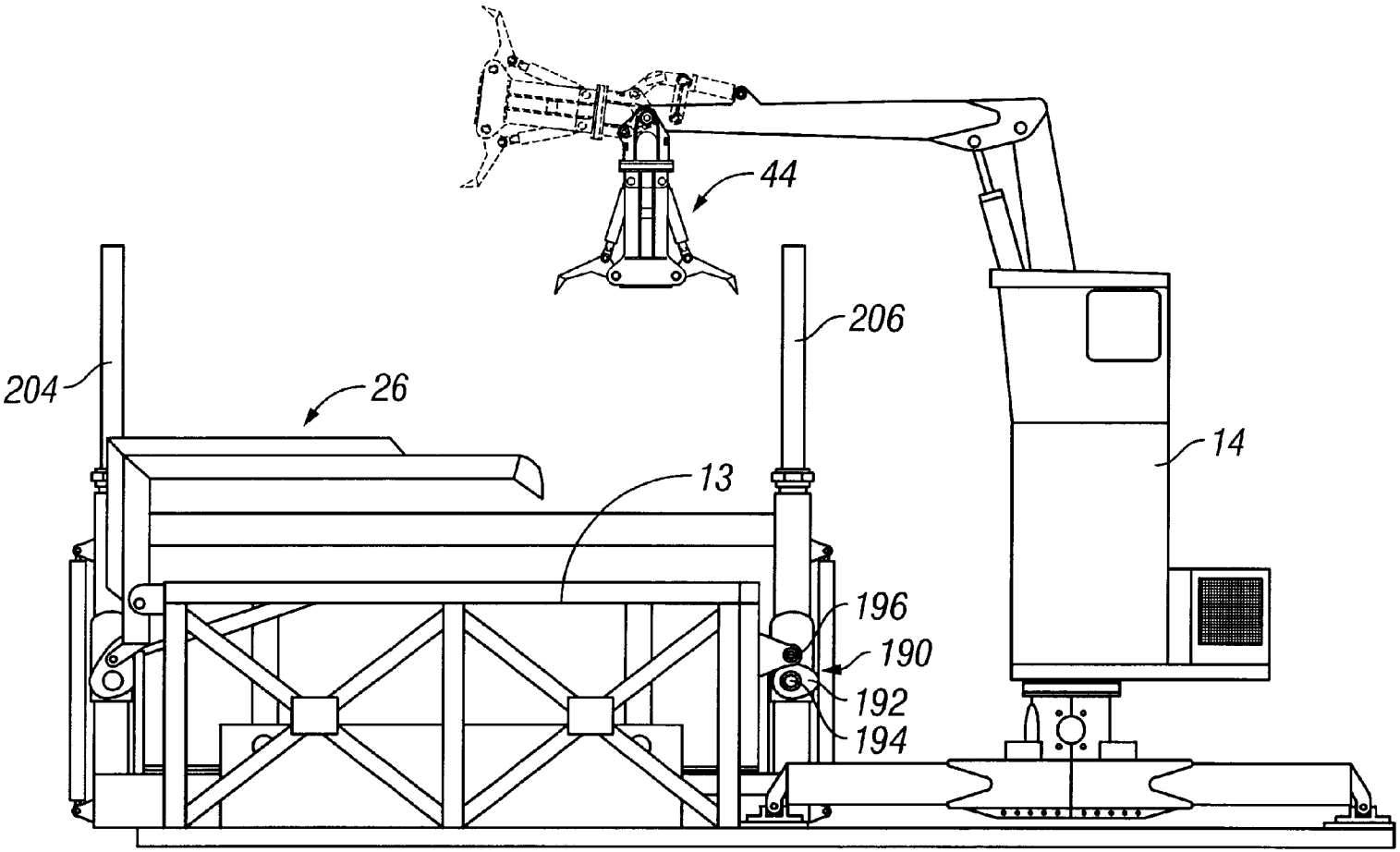
FIG. 17 is an elevation view of a second embodiment of a vehicle recycling system according to certain aspects of the present invention.
Figure 18:
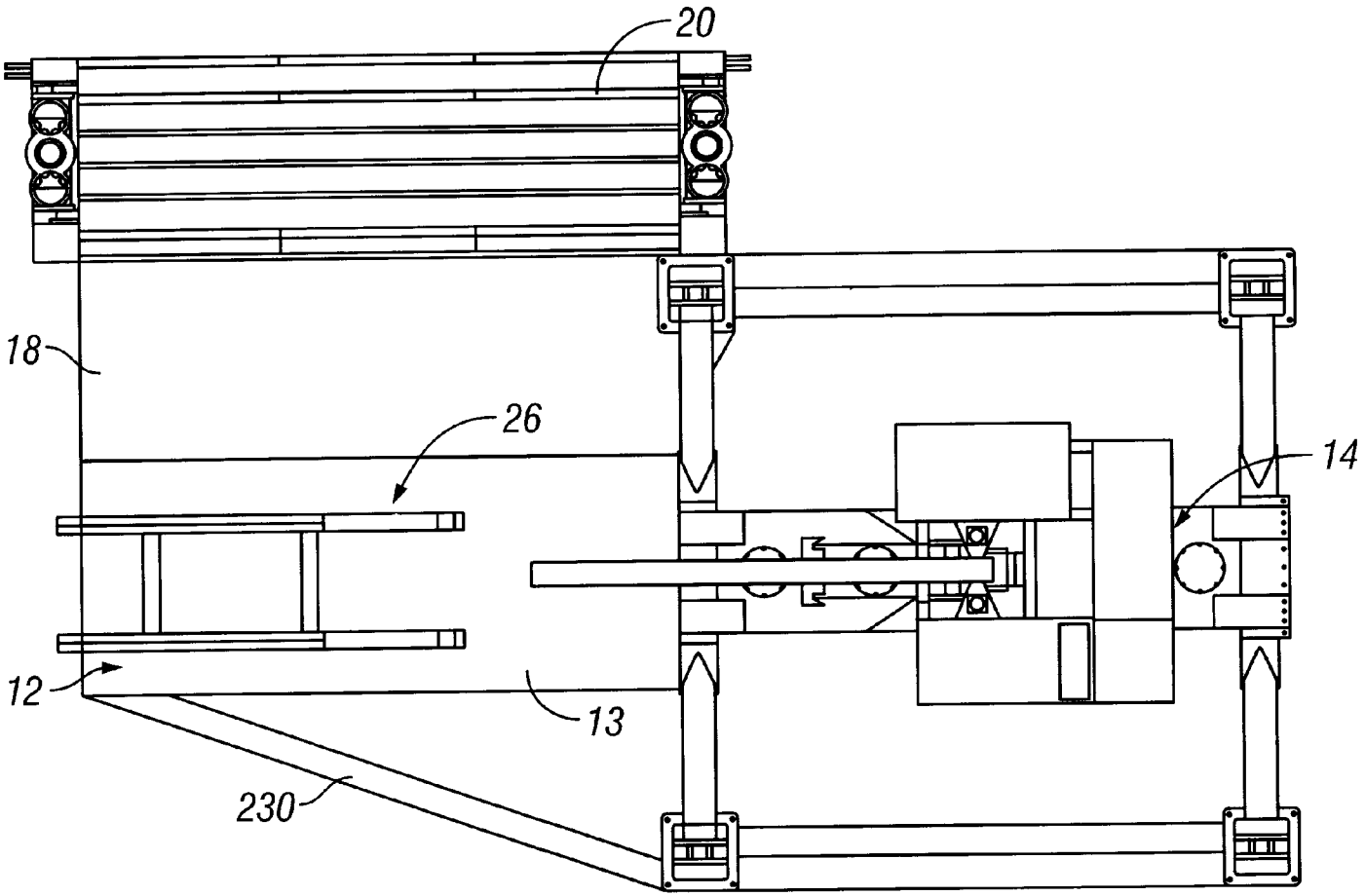
FIG. 18 is a top view of the vehicle recycling system of FIG. 17.

The recycling process begins by placing a vehicle 21 onto the hold-down table 13 using a loader or forklift. In the illustrated embodiment, the hold-down table 13 includes a staging area 22 and a hold-down area 24, each of which is sized to hold a vehicle. In this respect, the hold-down table 13 may have a length on the order of 240 inches and a width on the order of 190 inches, such that the staging and hold-down areas are approximately 95 inches wide. Alternatively, as is shown in FIGS. 10 and 17–18, the staging area can be eliminated from the hold-down table 13 to further reduce the size of the system 10. The crane 14 is used to move the vehicle from the staging area 22 to the hold-down area 24 where it is held down by a hold-down mechanism 26. The hold-down mechanism 26 prevents the vehicle from moving vertically during the time the engine is being pulled from the engine compartment of the vehicle. During engine removal, the operator maneuvers the boom 28 of the crane 14 to pop the hood of the vehicle 21 and remove desired components from the vehicle, such as its radiator, condenser, engine and transmission.

Individual components that do not require further processing, e.g. radiators, can then be placed into bins 114 that are positioned adjacent to the crane 14. Preferably, separate bins are provided for each type of component that is to be salvaged, so that like components from several vehicles can be placed into a single bin. Components, such as the engine/transmission assembly, that require further disassembly are fed to the component disassembly station 16 via a conveyor or roller system. As is explained below, the components are then further disassembled and placed in segregated bins 128 that are located adjacent to the disassembly station. Once the engine and other high value components are from the vehicle, the crane operator loads the vehicle onto the bed of the feed press 18. The feed press then moves the vehicle onto the bed of the material press 20 where it is compressed by the lid of the press. After the vehicle has been crushed, the back wall of the press is raised to allow the crushed vehicle to be removed by a material handling vehicle such as a loader. (See FIG. 2).

The crane 14 is of a conventional boom type crane. A suitable crane is a model 2100, which is commercially available from Northshore Manufacturing of Two Harbors, Minn. In the present application, the boom length of the Model 2100 have been modified, i.e., lengthened, so that the crane has the necessary reach. Specifically, the crane is configured so that it can move components between the hold-down table 13, storage bins 114, drop chute 116, feed press 18, and, in some applications, the material press 20. It will be appreciated that selection of the configuration of the crane is a function of he layout and size of the other components of the recycling system 10. The crane 14 has a base 30 which rests on the concrete floor 19 and a tower 32 that is rotatably connected to the base for movement thereabout. The tower has an elevated operator's compartment 34 where the crane operator sits and controls operation of the crane via conventional control mechanisms, such as control levers (not shown). The elevated operator's compartment 34 is beneficial because it provides the crane operator with a clear view of the entire recycling system 10. As such, the operator's component 34 can serve as a central operating station or control tower for other components of the recycling system 10. For example, in addition to including controls for the crane 14, the operator's compartment 34 can include controls for actuating the feed press 18, the hold-down mechanism 26, and the material press 20. Such a construction reduces the number of people required to run the recycling system, thereby reducing operating costs and increasing the efficiency and productivity of the system.

The boom 28 of the crane 14 includes a first arm 36 which is pivotally connected about its lower end near the base of the crane for pivotal movement about a generally horizontal axis. A conventional, double-acting hydraulic cylinder (not shown) is provided for controlling the position of the first arm 36 relative to the base. The hydraulic cylinder 38 extends between the base 30 and the first arm 36 and can be extended to raise the first arm and retracted to lower the first arm.

The boom 28 also includes a second arm 40 which has one end pivotally connected to the upper end of the first arm 36 for pivotal movement about a generally horizontal axis. A conventional, double-acting hydraulic cylinder 42 extends between the first and second arms 36, 40 for controlling movement of the second arm 40 relative to the first arm 36. The hydraulic cylinder 42 can be extended to pivot the second arm 40 upwardly relative to the first arm 36 and can be retracted to lower the second arm relative to the first arm. An engine pulling mechanism 44 (which is described in greater detail below) is pivotally connected to the second (distal) end of the second arm 40 for rotation about a generally horizontal axis. A conventional, double-acting hydraulic cylinder 46 extends between the second arm 40 and the engine pulling mechanism 44 for controlling the position of the engine pulling mechanism relative to the second arm. The hydraulic cylinder 46 can be extended to lower the engine pulling mechanism 44 relative to the second arm 40 and can be retracted to raise the engine pulling mechanism relative to the second arm.

As will be appreciated, the crane 14 includes a conventional hydraulic system (not shown) which is adapted to controllably deliver hydraulic fluid to the hydraulic cylinders. The hydraulic system includes a hydraulic pump assembly (not shown) which is powered by an electric motor in a convention manner for supplying hydraulic fluid to the cylinders via fluid lines (not shown). Controls are provided in the operator's compartment for controlling the flow of fluid to the cylinders, thereby controlling movement of the crane boom and the engine puller.

Figure 8:
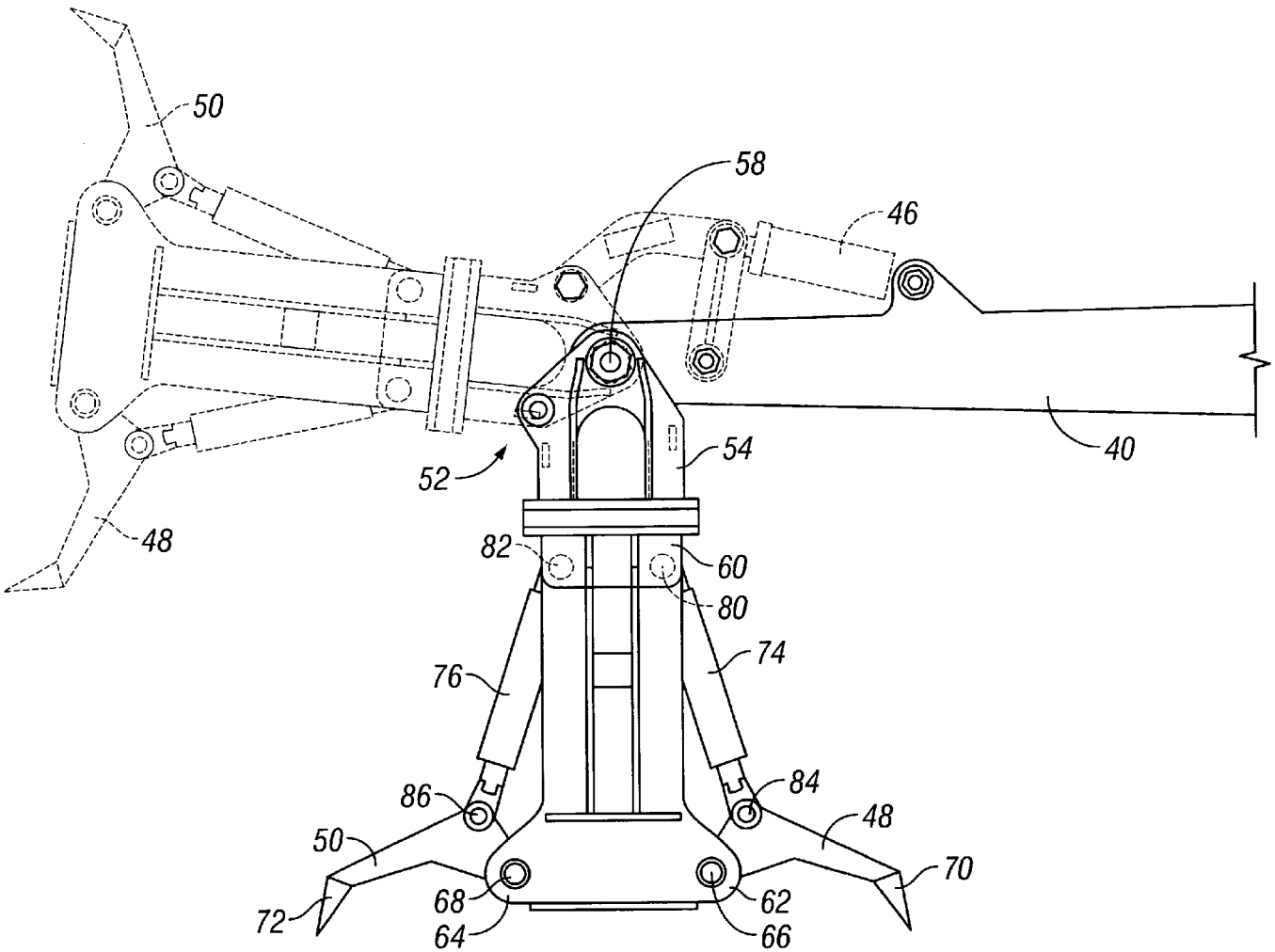
FIG. 8 is an enlarged elevation view showing an engine pulling mechanism employed in the system of FIG. 1.
Figure 9:
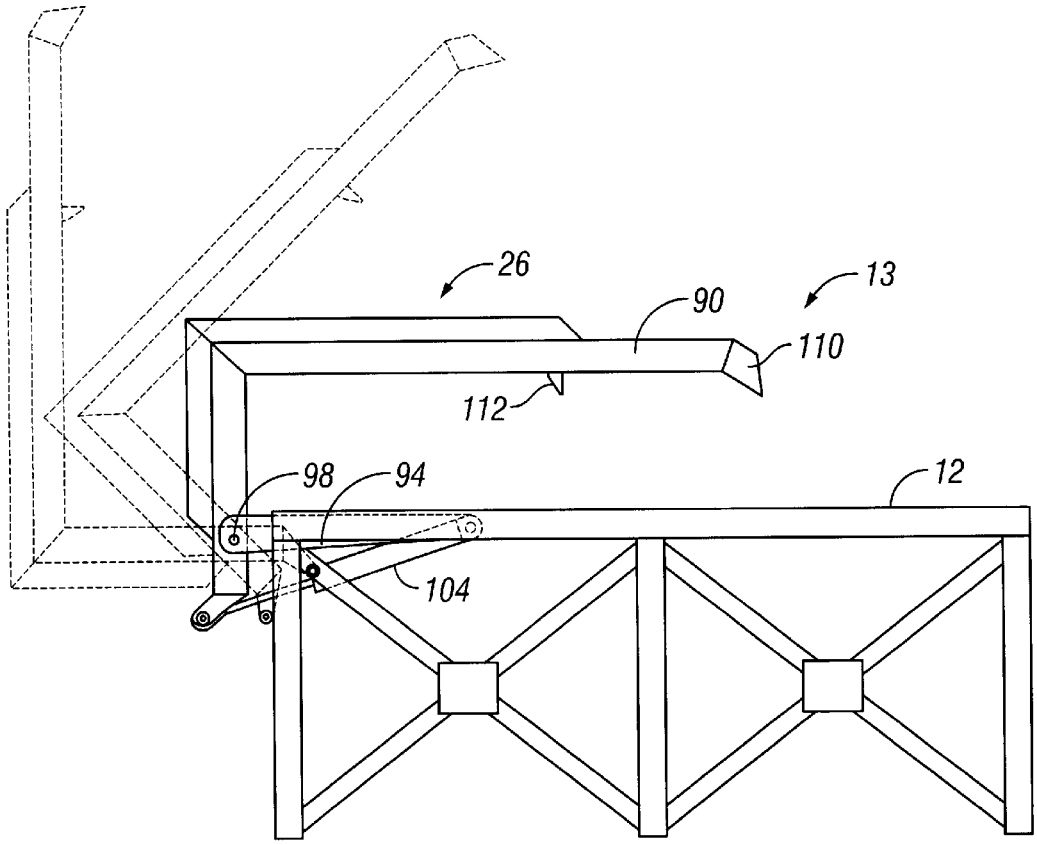
FIG. 9 is a side elevation view of the hold-down table and hold-down mechanism according to certain aspects of the present invention.

As can best be seen in FIG. 8, the engine pulling mechanism 44 includes a pair of hydraulically actuated tongs 48, 50 which are adapted to selectively grip the sides of the engine to be removed from a vehicle located on the hold-down table 13. A suitable engine pulling mechanism is constructed in accordance with the principles described in U.S. Pat. No. 3,685,128, entitled "Machine and Method for Removing Engines From Vehicles," the disclosure of which is hereby incorporated by reference herein. The tongs 48, 50 are constructed so that they may be inserted into the engine compartment between the sides of the engine and the sides of the compartment to grip the engine while the engine is still mounted in the vehicle. As described in the '128 patent, the tongs 48, 50 have pointed ends 70, 72 which permit limited relative pivotal movement between the engine and the tongs as the engine is being pulled from the vehicle. The tongs 48, 50 are mounted for pivotal movement on a beam 60 which, in turn, is mounted on and is carried by the distal end of the boom of the crane.

During the engine removal operation, the engine is gripped by tongs 48, 50 and is initially lifted so that the front end of the engine is first broken free from its engine mounts and is moved vertically, with respect to the rear end of the engine, in the engine compartment. When the bottom of the front end of the engine is above the top of the radiator, the engine is then pulled, at an angle with respect to the vertical, so that the engine and the transmission are pulled out of the engine compartment up over the front end of the vehicle. By pulling the engine out in this manner, the transmission may be easily removed from the vehicle with minimal danger that the transmission will break away from the engine since there is no contact between the transmission and any structural portion, such as the firewall, of the vehicle during the removal operation.

The engine pulling mechanism 44 is pivotally connected to the distal end of the second arm 40 by a pivot coupling 52 formed at the upper end of the engine pulling mechanism. This coupling 52 provides the engine pulling mechanism with approximately 97° of rotation. The pivot coupling 52 includes a pair of vertical coupling plates 54 (one shown in FIG. 8) which are pivotally connected to the distal end of the second arm 40 by a pivot pin 58. A beam or member 60 extends downwardly from the coupling member 52. The beam 60 has a pair of laterally extending, parallel flanges 62, 64 extending from its lower end. The tongs 48, 50 are pivotally connected, at their upper ends, to the flanges 62, 64, by pins 66, 68, respectively.

The structurally identical tongs 48, 50 have pointed lower ends 70, 72 so as to permit point contact between the tongs and the sides of the engine to be removed. A pair of conventional, double-acting hydraulic cylinders 74, 76 move the tongs 48, 50 about axes which are coaxial with the axes of the pins 66, 68 and which are arranged so that the tongs move in a plane which is parallel to the plane of the beam 60. The upper ends of the cylinders 74, 76 are pivotally connected to the upper end of the beam 60 by pins 80, 82, respectively. The rod ends of the cylinders 74, 76 are pivotally connected to the tongs 48, 50, respectively, by pins 84, 86. The cylinders 74, 76 are connected to the tongs 48, 50 at points closer to the upper ends of the tongs than the lower ends 70, 72. Also while the upper ends of the tongs 48, 50 are spaced from each other, the tongs are shaped so that the lower ends 70, 72 may be brought into contact.

The hold-down mechanism 26 is provided for holding the vehicle in place on the hold-down 13 while the engine puller 44 is used to pull the engine, transmission and other valuable components, e.g. the radiator, from the vehicle. As is shown in greater detail in FIGS. 9–12, the hold-down mechanism 26 includes two generally L-shaped hold-down beams (or legs) 90 which are pivotally connected to the back end of the hold-down table 13 for movement between a retracted or open position (shown in phantom in FIG. 9) and an extended or hold-down position (shown in solid in FIG. 9). For this purpose, the table 13 includes a pair of coupling members 94 (see FIGS. 12A and 12B) that are secured to the underside of the table 13. Each of the coupling members 94 is associated with a different one of the beams 90. The outer ends 96 of the coupling members 94 are connected to the hold-down beams 90 by pins 98 to permit the beams to pivot relative to the table 13. When the hold-down mechanism 26 is in its extended position, as shown in FIG. 1 and in solid line in FIG. 9, the beams 90 are substantially horizontal and are in contact with the upper surface of the of the vehicle 21 from which the engine is to be pulled, thereby restricting and restraining the vehicle against movement while the engine is being removed via the engine pulling mechanism. When the mechanism 26 is moved to its retracted or open position, as shown in phantom in FIG. 9, the beams 90 are substantially perpendicular to the bed of the hold-down table 13 so that they do not interfere as vehicles are being loaded onto and off of the table.

In the preferred embodiment, the beams 90 are interconnected by transverse beams 100 to form a unitary assembly. A pair of conventional, double-acting hydraulic cylinders 104 are provided for moving the beams 90 between their retracted and extended positions. Each cylinder 104 has one end coupled to the inner end 106 of a respective coupling member 94 and the other end (the rod end) connected to a respective hold down beam 90. The cylinders 104 are extended to move the beams 90 to the hold-down position and retracted to move the beams to their open position.

The beams 90 have pointed distal ends 110 which extend downwardly to engage against and grip the body of a vehicle positioned on the bed of the hold-down table 13. Similarly, at least one of the transverse members 100 may carry a row of downwardly extending teeth 112 positioned to engage against and grip the body of a vehicle positioned on the bed of the hold-down table 13.

Figure 10A:
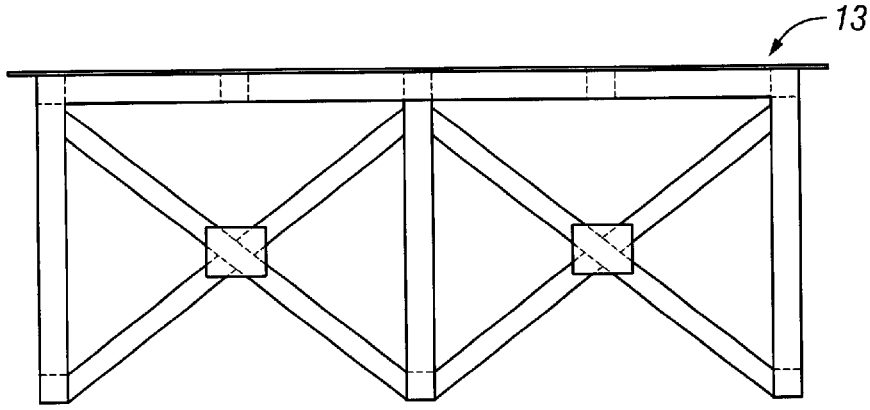
FIGS. 10A–C are side, end and top elevation views, respectively, of the hold-down table of FIG. 9
Figure 10B:
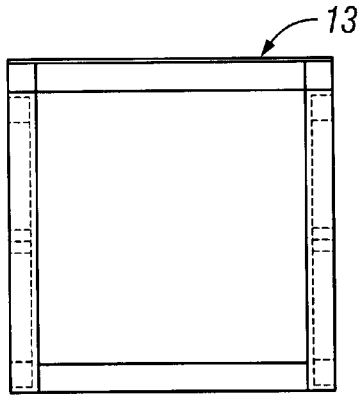
Figure 10C:
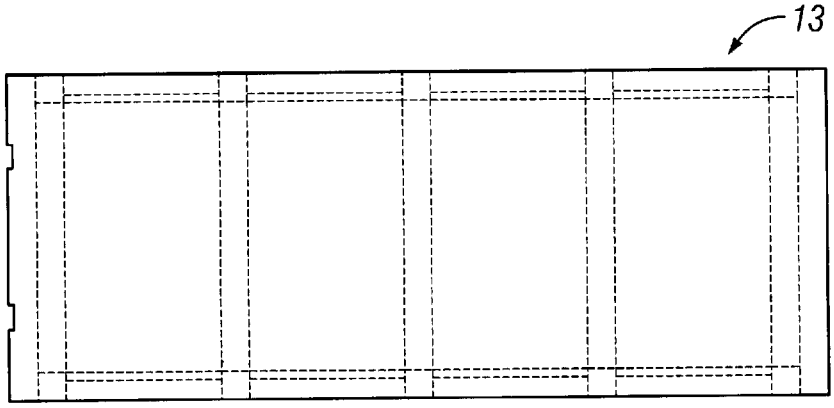
Figure 11A:
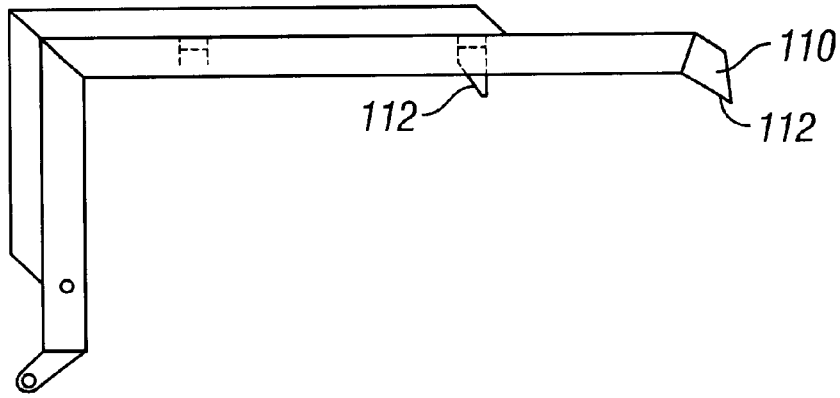
FIGS. 11A–C are component drawings for the hold-down arm employed in the hold-down mechanism of FIG. 9.
Figure 11B:
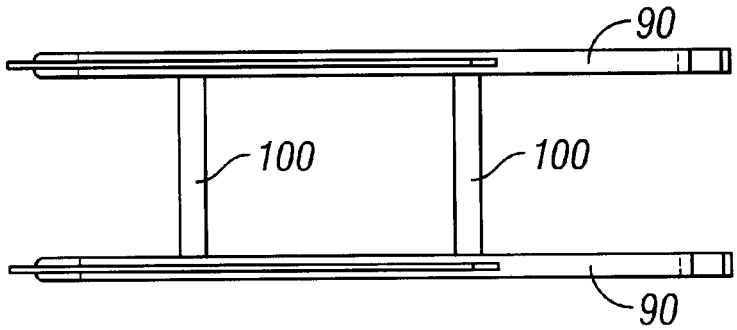
Figure 11C:
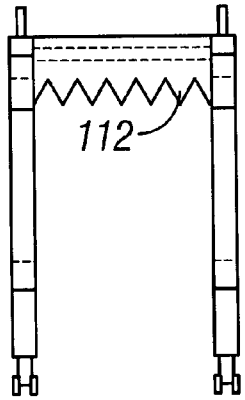
Figure 12A:
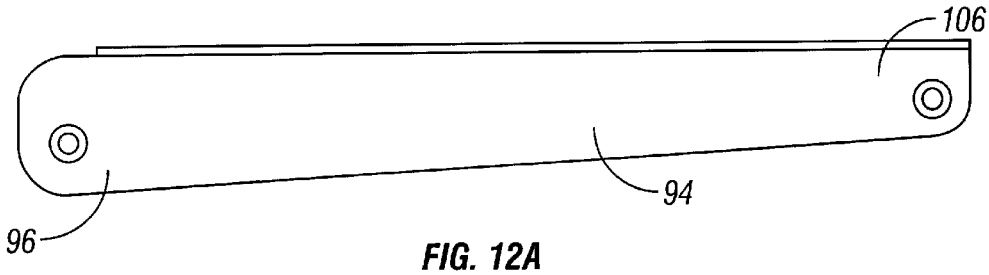
FIGS. 12A and 12B are component drawings of a hold-down mounting bracket employed in the hold-down mechanism of FIG. 9.
Figure 12B:
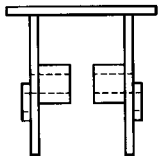
Figure 13:
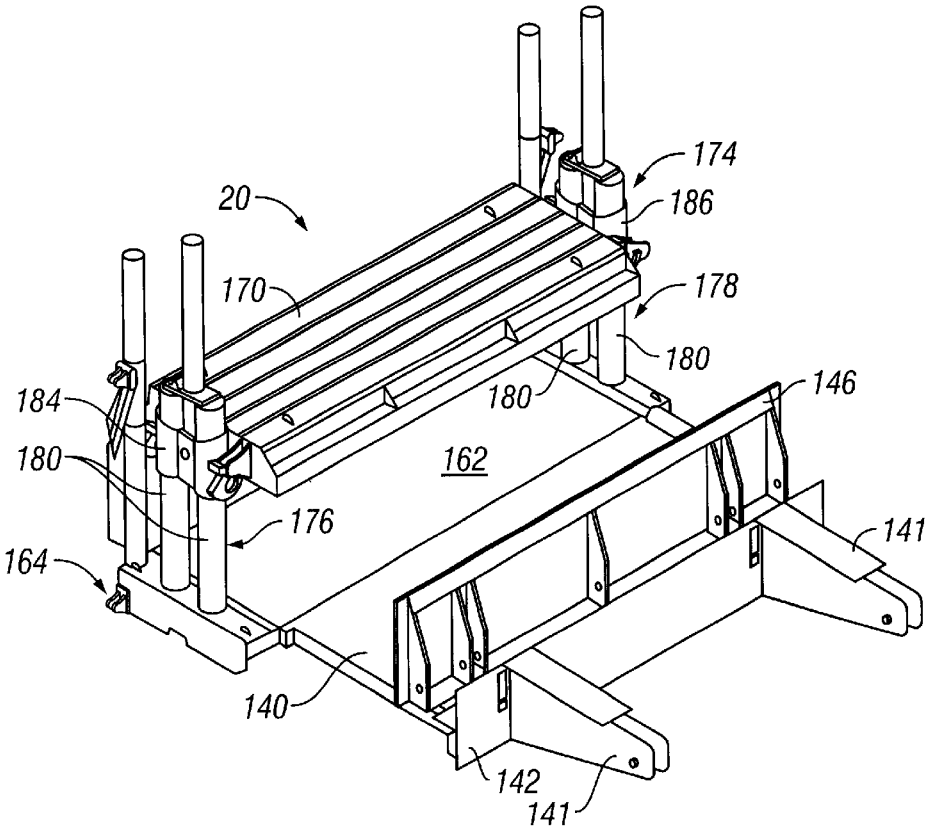
FIG. 13 is a perspective view of a feed press and material press subassembly employed in the system of FIG. 1
Figure 14:
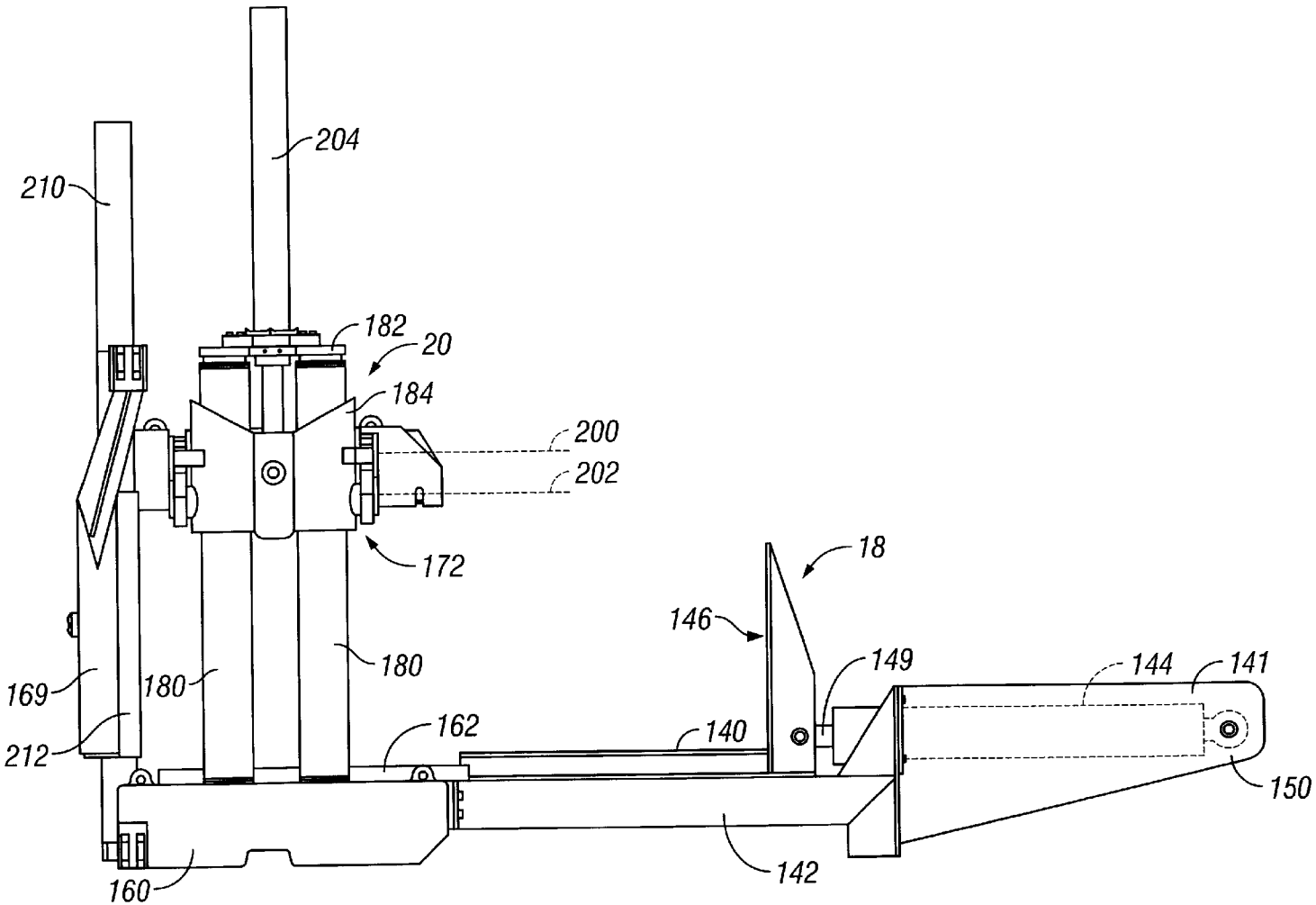
FIG. 14 is a side elevation view of FIG. 13 showing the feed press in its retracted position

In the illustrated embodiments, the hold-down mechanism 26 is carried by the hold-down table 13. It will be appreciated, however, that the hold-down mechanism 26 could be carried by the boom 28 of the crane 14, as is described in the '128 patent. Moreover, as is illustrated in FIGS. 10A–10C, the hold-down table 13 may be configured so that it is only wide enough to accommodate a single vehicle. In this embodiment, the staging area 22 has been eliminated to further reduce the space required for the system 10.

Individual components that do not require further processing, e.g. radiators, can then be placed into bins 114 that are positioned adjacent to the crane 14. Preferably, separate bins are provided for each type of component that is to be salvaged, so that like components from several vehicles can be placed into a single bin. Components, such as the engine/transmission assembly, that require further disassembly are fed to the component disassembly station 16 via a conveyor or roller system. In the illustrated embodiment, the crane 14 is used to drop components into a chute 116 which leads to a first conveyer or roller table 118. The first conveyor 118 extends between the chute 116 and work table 120. A pair of parallel conveyors or roller tables 122 extend between the work table 120 and a bin storage area 124 (and generally perpendicular to the first conveyor 118). An overhead crane system 126 is mounted above the disassembly area 16 for moving the components between the conveyors, work table and storage bins. In operation, engine/transmission assemblies are dropped into the chute 116 using the crane 14. The engine/transmission assemblies slide down the chute 116 and onto the first conveyor 118. The assemblies are moved along the conveyor 118 to the work table 120. The overhead cranes 126 can be used to move the assemblies between the conveyor 118 and the work table 120. The components are then disassembled by workers and moved along and the parallel conveyors 122 to the storage bins 128.

Figure 15:
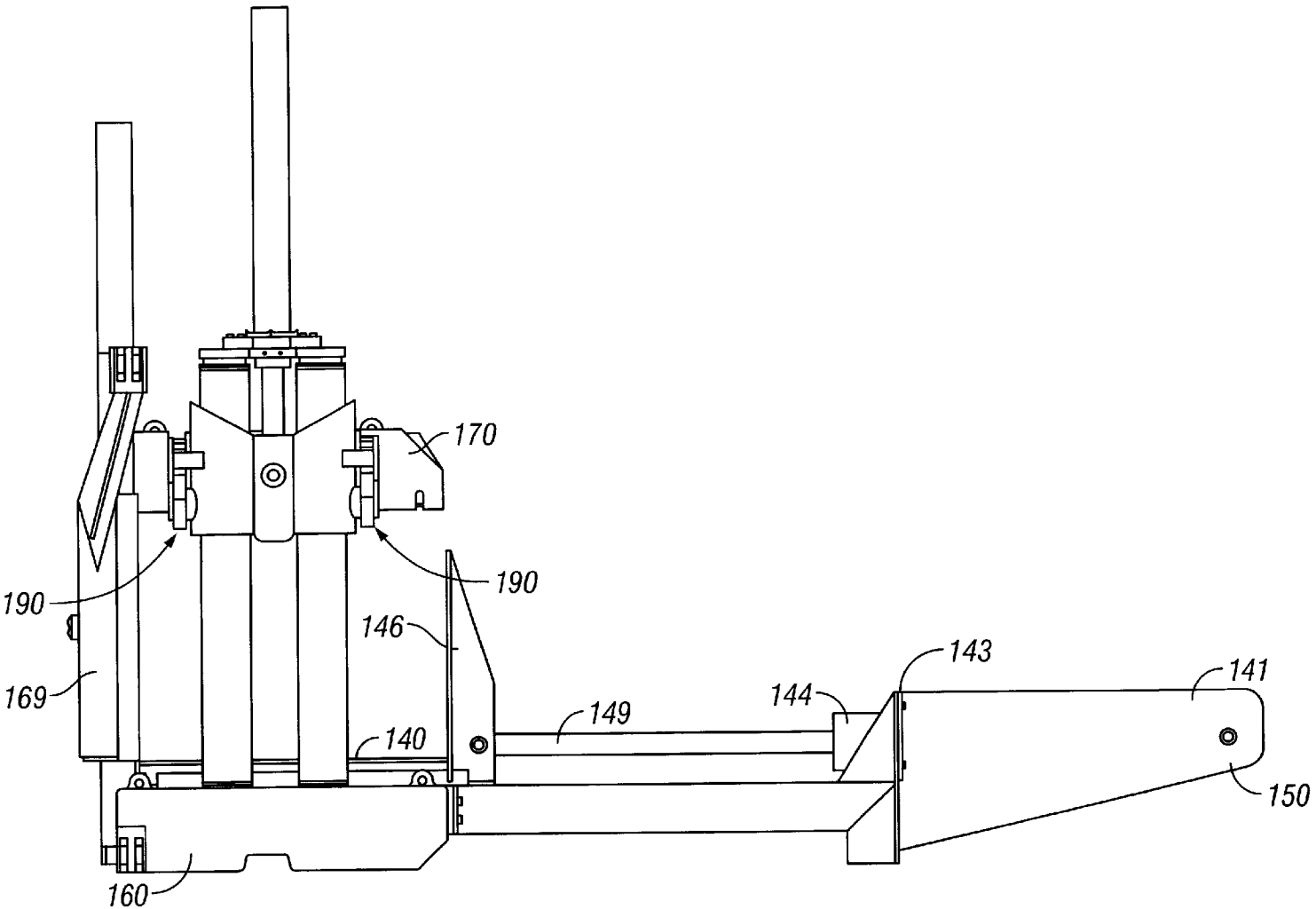
FIG. 15 is a side elevation view of FIG. 13 showing the feed press in its extended position
Figure 16:
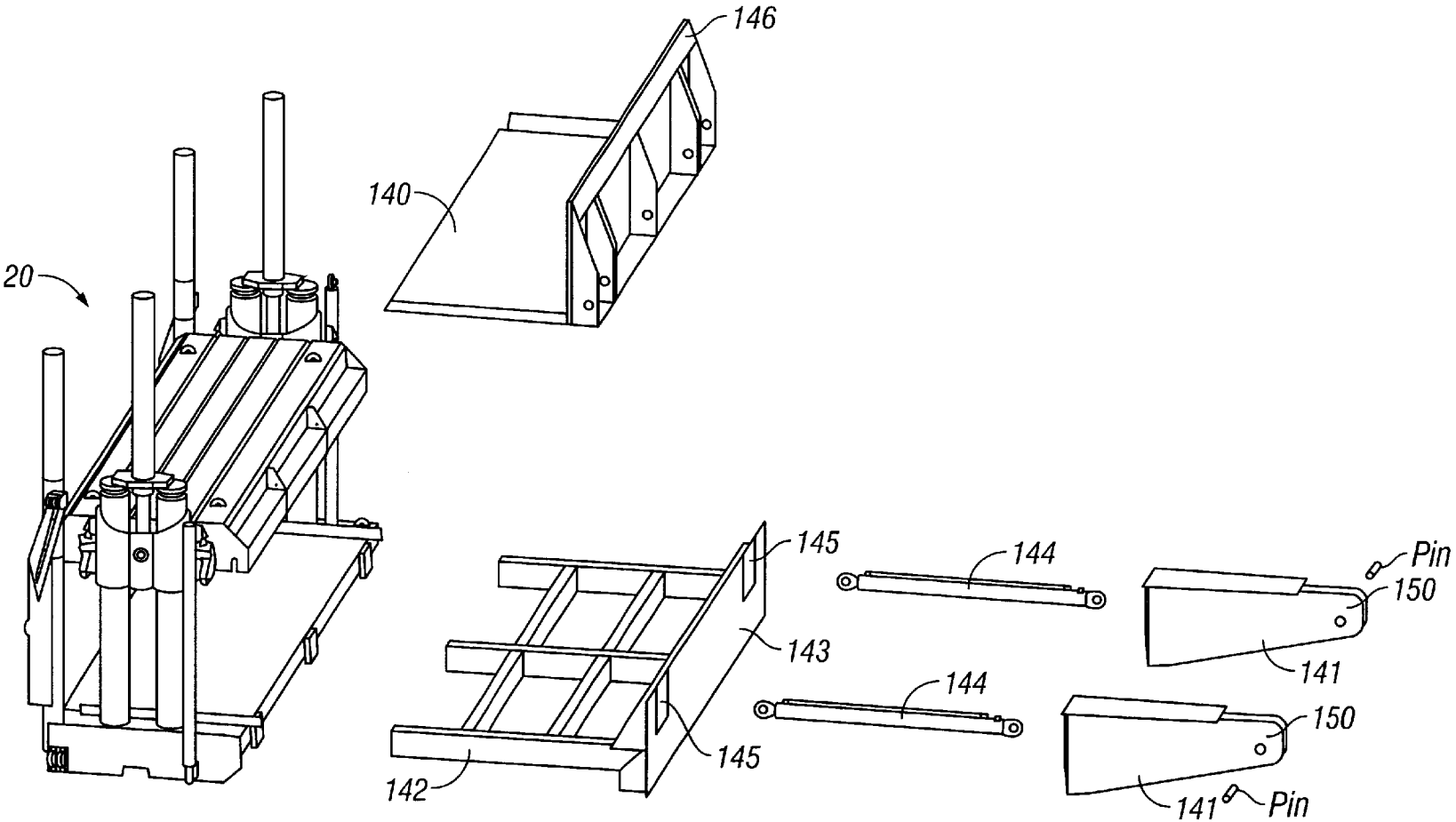
FIG. 16 is an exploded perspective view of the feed press.

Once the desired components are removed from the vehicle, the crane operator loads the vehicle onto the feed press 18. The feed press 18 can best be seen in FIGS. 13–16. The feed press 18 has a generally rectangular bed 140 which is sized to receive a vehicle. The bed is slidably mounted on a frame 142 that rests on the floor 19. The frame 142 of the feed press 18 can be secured to the material press 20, e.g., by fasteners or welding, to fix the relative location of the presses 18, 20. Conventional, double-acting hydraulic cylinders 144 are connected between the frame 142 and the bed 140 for moving the bed between its retracted or loading position (FIG. 14) and its extended or crushing position (FIG. 15). For this purpose, the frame includes cylinder mounting brackets 141 that extend from the back wall 143 of the frame and align with slots 145 in the back wall 143. Each of the hydraulic cylinders 144 has its housing end connected to the distal end 150 of a respective one of the mounting brackets 141. The mounting brackets 141 are configured such that the cylinders 144 are housed within the brackets 141. The rods 149 of the cylinders 144 extend through the slots 145 and are secured to the back wall 146 of the bed by pins. The cylinders 144 can be retracted to move the bed to its retracted position and extended to move the bed to its extended position. In its retracted position, the bed is adjacent to and interposed between the hold-down table 13 and the material press 20. (See FIGS. 1 and 14). In its extended position (see FIGS. 2 and 14), the bed 140 overlies and is supported from below by the bed of the material press 20. The vertical back wall 146 extends upwardly from the back edge of the bed 140 to retain the vehicle on the bed as the bed is moved towards its extended position. In operation, the bed 140 is initially moved to its retraced position. The crane operator then moves the vehicle from the hold-down table 13 and onto the bed of the feed press 18. The bed of the feed press 18 is then moved to its extended position so that it (and the vehicle) overlays the bed of the material press 20. The bed of the material press 20 may include guides for receiving and guiding the bed 140 of the feed press as it moves to its extended position. The lid of the material press 20 is then lowered to crush the vehicle located on the bed.

Figure 19:
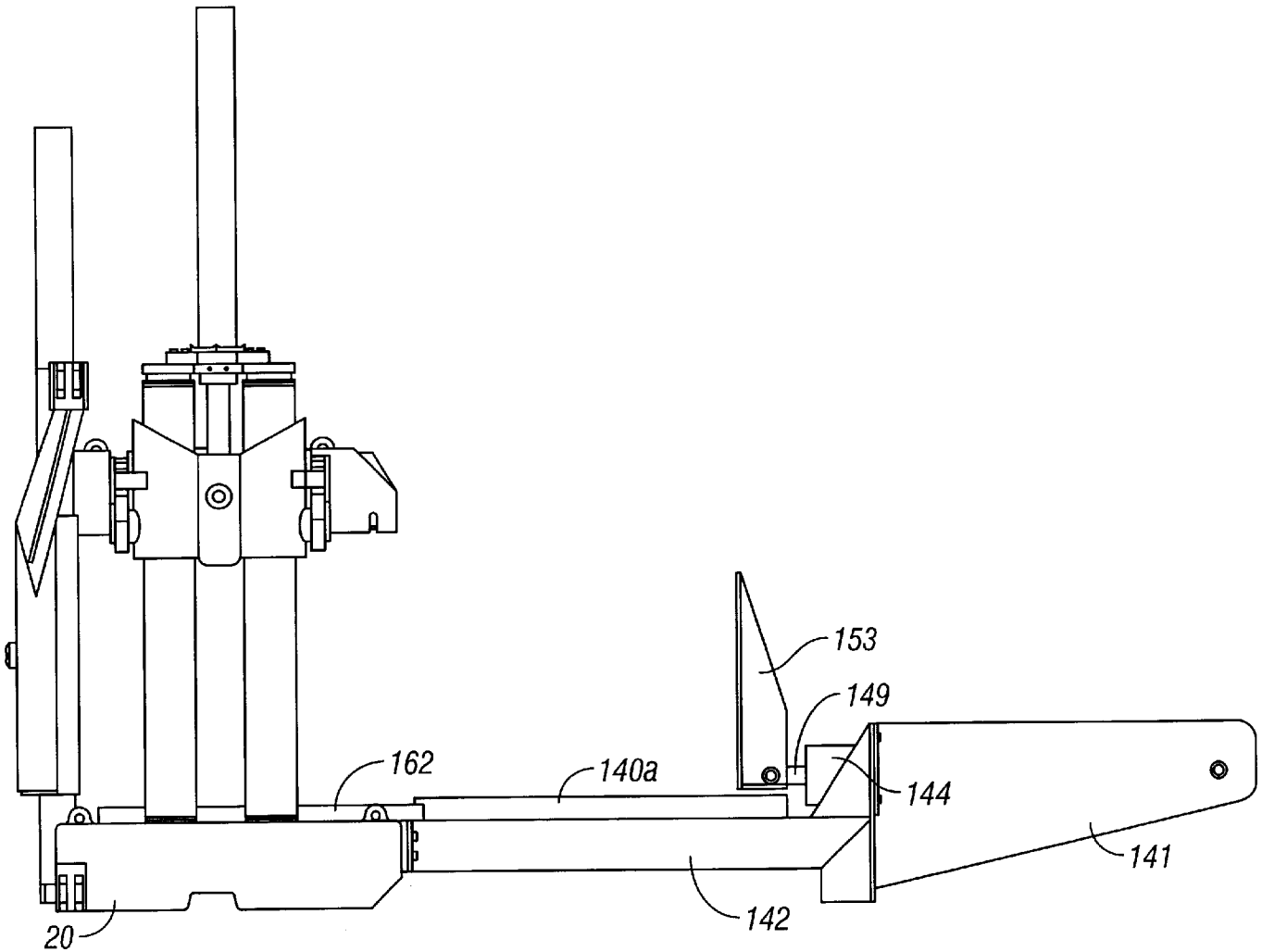
FIGS. 19 and 20 illustrate an alternative embodiment of a feed press in accordance with certain aspects of the present invention.
Figure 20:
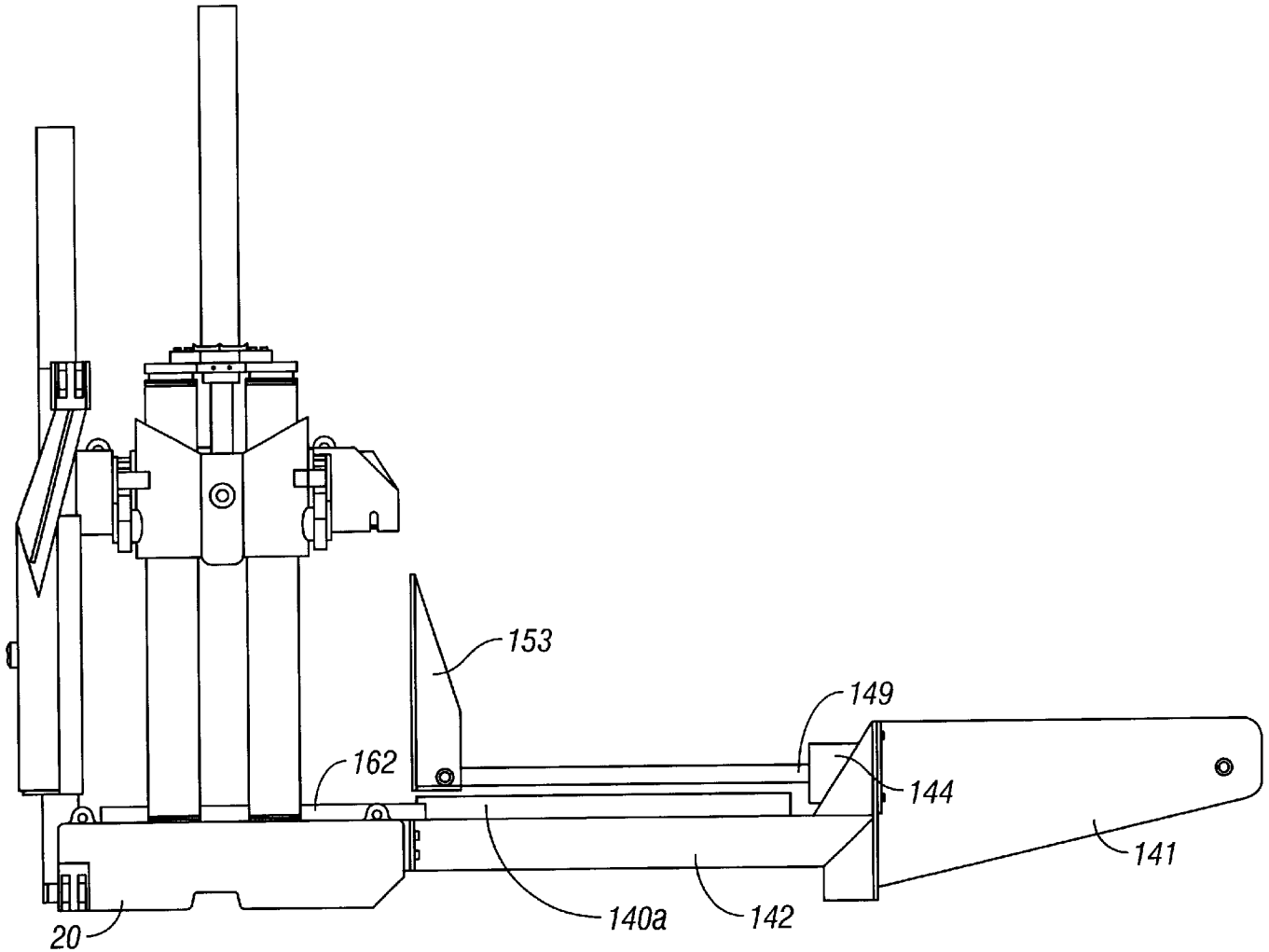

In an alternative design shown generally in FIGS. 19 and 20, the feed press 18 has a fixed bed 140*a* and a movable pusher plate 153. In such a design, the bed is constructed so that its top face aligns vertically with (or is slightly higher than) the top face of the bed 162 of the material press 20. The hydraulically actuated pusher plate 153 moves laterally across the bed 140*a* of the press 18 between a retracted position at which it is laterally displaced from the material press 20 (see FIG. 19) and an extended position at which it is adjacent to the press 20 (see FIG. 20). The double-acting hydraulic cylinders 144 are connected between the frame 142 (and, in particular, the brackets 141) and the pusher arm 153 for moving the pusher arm between its extended and retracted position. In operation, the pusher arm 153 is moved to its retraced position (FIG. 19). The crane operator loads the vehicle onto the bed 140*a* of the feed press 18. The pusher arm 153 is then moved laterally across the bed 140*a* to its extended position (FIG. 20) to push the vehicle from the feed press 18 and onto the bed 162 of the adjacent material press 20.

The material press 20 is constructed generally in accordance with the press (and specifically the stationary embodiment of FIGS. 11 and 12) described in U.S. Pat. No. 5,782,176, entitled "Material Press Having Pivotally Connected Crushing Lid and a Reducible Height For Transit," the disclosure of which is hereby incorporated by reference herein. The material press 20 includes a base portion 160 defining a generally horizontal bed 162 upon which a vehicle (or other material) to be crushed may be placed. Material placed on the bed is crushed by a lid 170 which is slidably movable relative to the bed 22 along a pair of vertical guide mechanisms 172, 174 by a pair of hydraulic cylinders 204, 206.

The first and second guide mechanisms 172, 174 are disposed opposite ends of the bed, respectively. Each guide mechanism 172, 174 includes a respective pair 176, 178 of cylindrical guide posts 180 which extend upwardly from the bed 162 of the press 20. The guide posts 180 in a given pair are spaced equidistance on opposite sides of the centerline of the bed 162. The lower ends of the guide posts 180 are rigidly secured to the base of the press 20, e.g. by welding or other suitable means, and the upper ends of the guide posts in a given pair are rigidly secured to each other by a respective connecting linkage 182.

The guide mechanisms 172, 174 include guide sleeves 184, 186 which are slidably mounted on the first and second pairs 176, 178 of guide posts, respectively. As can be seen in FIG. 17, each guide sleeve 184, 186 is in turn pivotally connected to two corners of the lid 170 by a pair of pivot linkages 190 (one shown in FIG. 17). The pivot linkages 190 each comprise a rigid link member 192 and a pair of heavy duty pivot pins 194, 196. One of the pins 196 is pivotally connected to the lid 170 and the other pin 194 is pivotally connected to the guide sleeve 184, 186. The pivot linkages 190 permit pivotal movement of the lid 170 relative to the guide sleeve 184, 186 about two axis 200, 202. Each axis is generally parallel to the bed 162 and generally perpendicular to the vertical axis of the guide posts 42.

The guide mechanisms 172, 174 permit the lid 32 to slidably move relative to the bed 162 between a lowered position at which the lid is juxtaposed next to the bed and a raised position at which the lid is vertically displaced from the bed. The lid 32 is moved between its upper and lower positions by a pair of conventional double-acting hydraulic cylinders 204, 206 which are positioned at opposite ends of the lid. Specifically, the first hydraulic cylinder 204 is juxtaposed between the guide posts 280 in the first pair 176 and the second hydraulic cylinder 206 is juxtaposed between the guide posts 180 in the second pair 178.

Figure 2:
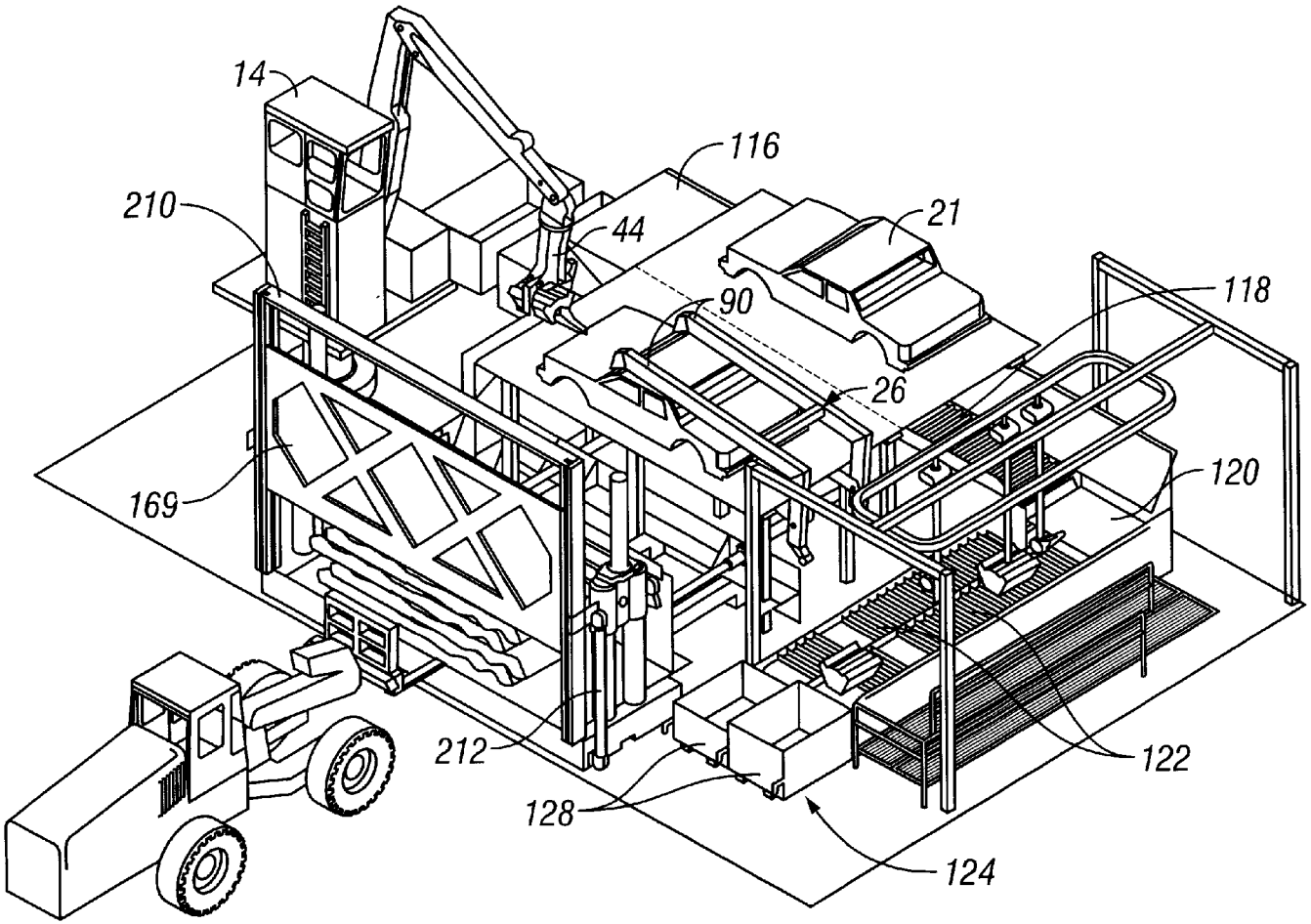
FIG. 2 is view similar to that of FIG. 1, showing a loader positioned to remove a stack of crushed vehicle bodies from the bed of the material press.
Figure 3:
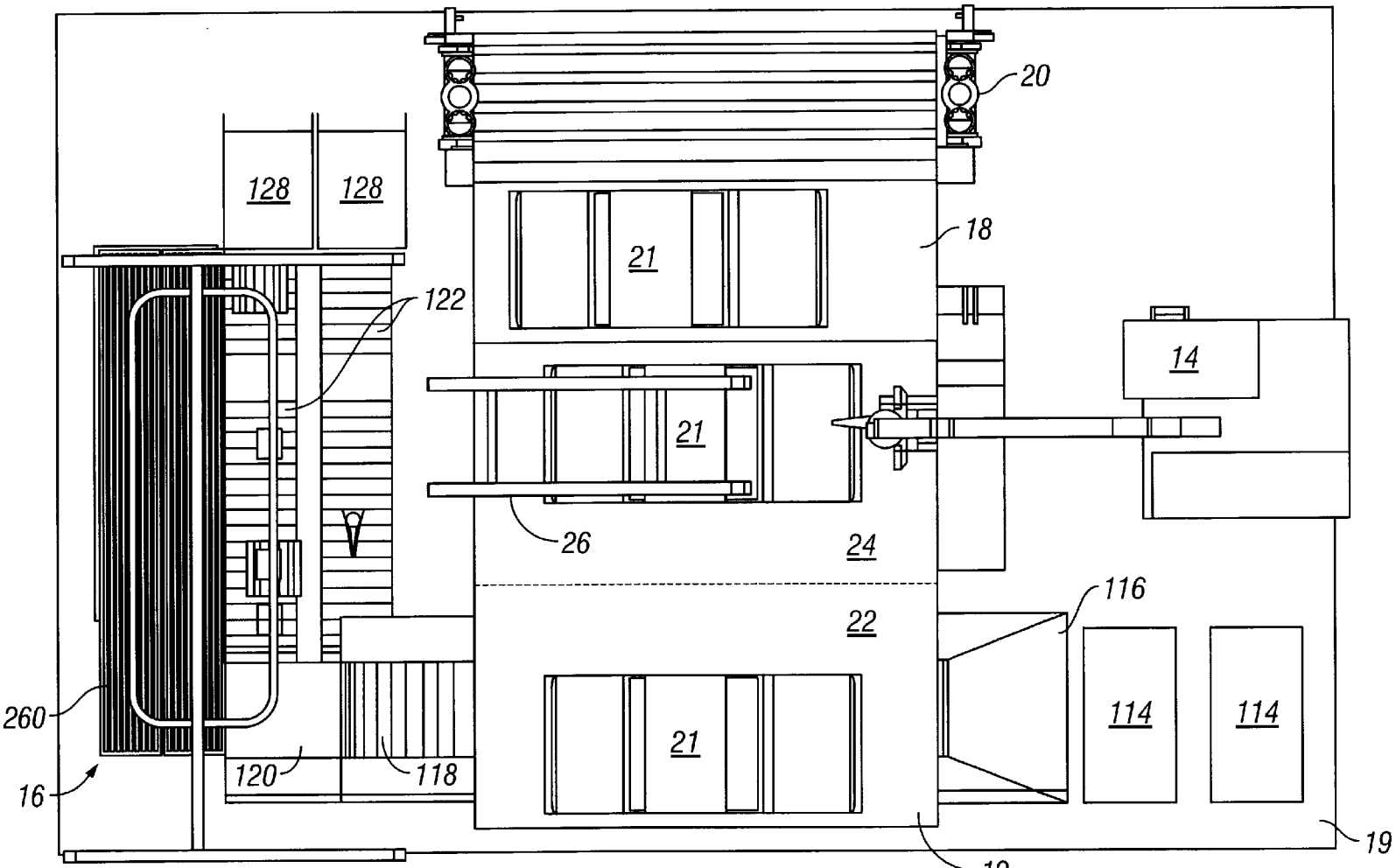
FIG. 3 is a top view of the vehicle recycling system of FIG. 1.
Figure 4:
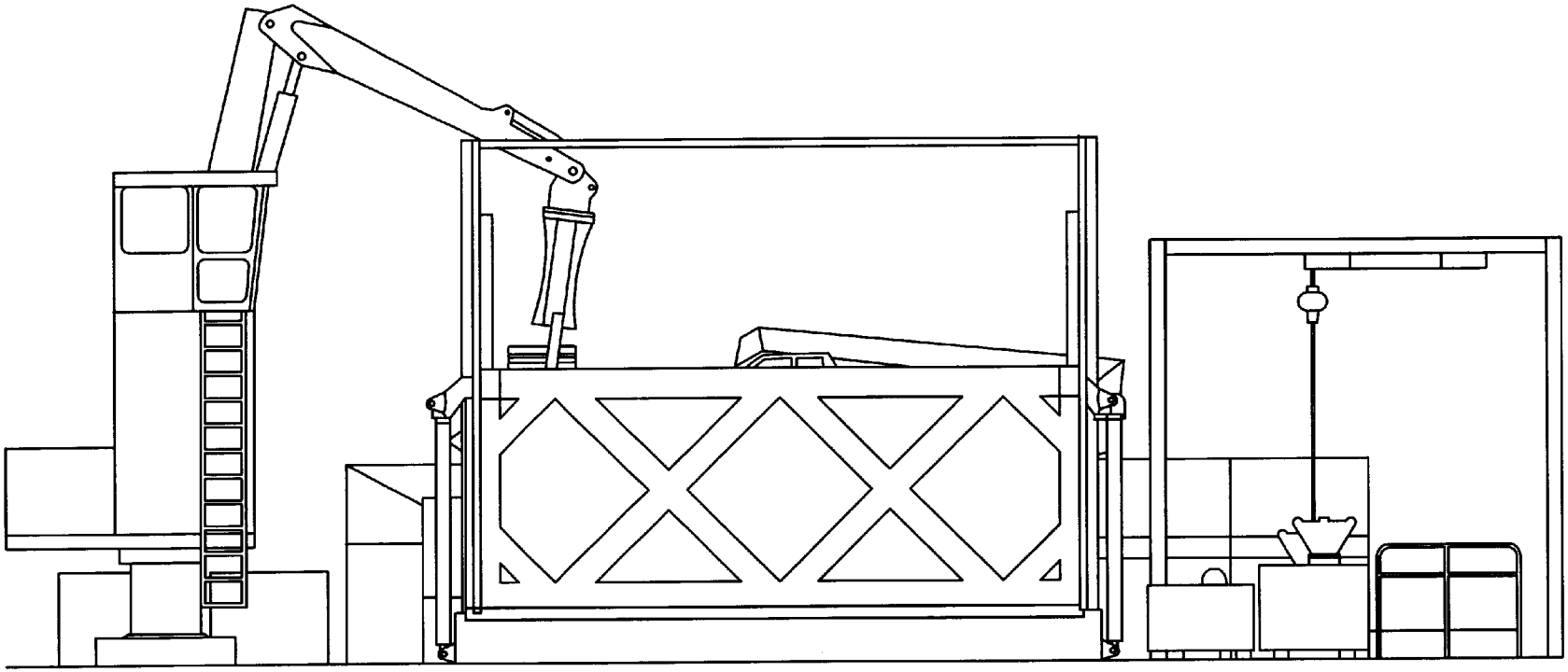
FIG. 4 is an elevation view of the vehicle recycling system of FIG. 1, looking towards the back wall of the material press.
Figure 5:
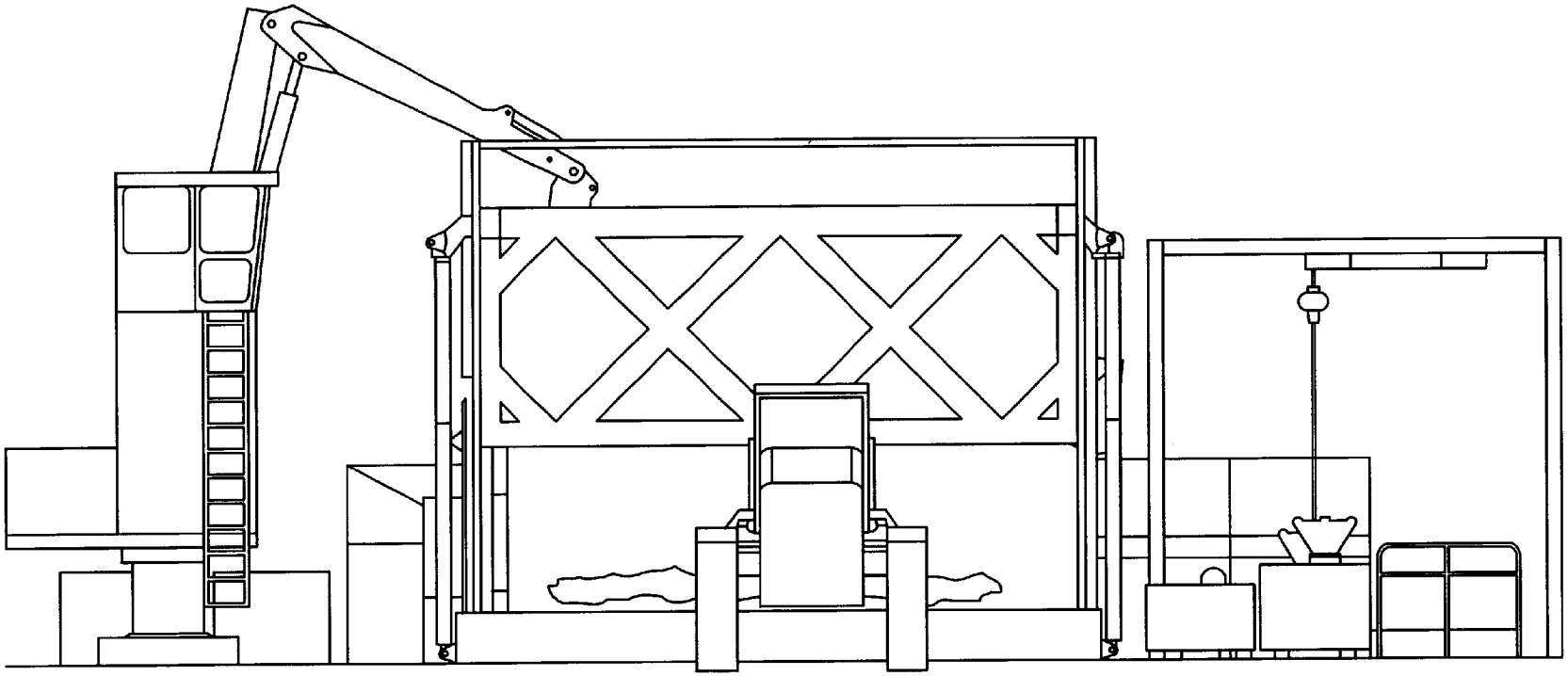
FIG. 5 is an elevation view similar to that of FIG. 4, showing a loader positioned to remove a crushed vehicle from the bed of the material press.

The back wall 169 of the press can be raised to permit vehicles to be removed from the back side of the press. For this purpose, the back wall 169 is slidably mounted in a frame 210 for movement between a lowered position (FIG. 1) and a raised position (FIG. 2). Double acting hydraulic cylinders 212 are connected between the base 160 and the back wall 169 for moving the back wall between its raised and lowered positions.

Referring now to FIGS. 17 and 18 an alternative embodiment according to certain aspects of the present invention will be described. Like components in the first and second embodiment have been identified with the same reference numbers. The second embodiment differs from the first embodiment in that component disassembly station 16 and the staging area 22 have been eliminated. One benefit of the second embodiment is that it can be constructed in a smaller area than the first embodiment, while providing most of the features of the first embodiment. Further space reductions could be obtained by eliminating the feed press 18. In such an arrangement the top of the hold-down table 13 is vertically aligned with (or slightly higher than) the top of the bed 162 of the material press 20 and the crane 14 is used to push the vehicle from the hold-down table 14 and onto the bed 162 of the material press 20.

The second embodiment may also include a base assembly 230 to which the individual components are attached. The base assembly 230 serves to stabilize the individual components and fix their positions relative to one another.

A vehicle system in accordance with the present invention offers several advantages over prior systems. First is the environmental benefit that comes from the recycling operation being moved indoors. Since the system is set on a concrete slab and inside, there are no ground water or rainwater run off issues. Hence this system is in strict compliance with edicts from the National Pollution Discharge Elimination System. Residual fluid is more easily removed and managed. In this respect, system can include a floor drain 260 which is connected to a collection tank 262 so that the waste fluids can be recycled and/or disposed of in accordance with applicable environmental standards (See FIG. 1). The tank can be buried under ground at a location outside of the building to provide easier access when the tank needs to be emptied. An indoor operation also reduces vandalism and theft. Because the system is indoors, it can remain operational during inclimate weather.

The system also reduces the amount of space required to process vehicles. Traditionally, a salvage operation requires a minimum of one to two acres. With the present system, all that is required is a small building to house the system and a storage area to stack the flattened vehicles. Moving the recycling operation indoors allows the auto recycler to inventory more cars in their yard which translates to more sales and higher profits.

Labor saving is an additional cost benefit, as only a few employees are need to operate the system. A single operator runs both the dismantling crane as well as the feed and material presses via remote control. In addition, there is one forklift operator and a couple of dissemblers. Clean up of the scrap process is also greatly reduced versus traditional disassembly methods since all of the steps take place in a single area.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. An indoor system for recycling scraped vehicles; comprising an engine pulling means for removing an engine from a vehicle that is to be scraped; and a hold down means for restraining the vehicle from moving in the direction in which the engine is being pulled by the engine pulling means while the engine is being removed from the vehicle;

a material press means for compressing the body of the vehicle once the engine has been removed from the vehicle;

means for moving the vehicle body into the material press following removal of the engine by the engine pulling means; and a building enclosing the engine pulling means, the hold-down means and the material press means.

2. The indoor vehicle recycling system of claim 1, further comprising a crane having a movable boom and wherein the engine pulling means comprises:

a member having first and second ends and being pivotally connected at its first end to boom of the crane;

a hydraulic cylinder connected between the boom of the crane and the member for pivoting the member relative to the boom;

a gripping means carried by the second end of the member for securely gripping an engine mounted in a vehicle.

3. A vehicle recycling system as set forth in claim 2, wherein the gripping means includes first and second tongs, each having first and second ends, each of the tongs being pivotally connected adjacent its first end to the second end of the member for pivotal movement relative to the member between a first, engine gripping position at the second ends of the tongs are adjacent to each other so as to be able to grip the sides of an engine to be pulled from a vehicle, and a second, open position at which the second ends of the tongs are spaced from one another, the gripping means further including first and second hydraulic cylinders connected between the member and the first and second tongs, respectively, and being adapted to move the tongs between their engine gripping and open positions.

4. The indoor vehicle recycling system of claim 1, wherein the material press means comprises:

a generally horizontal, elongated bed having first and second vertical guide mechanism extending from opposite ends of the bed;

a lid slidably connected to the guide mechanisms for vertically movement relative to the bed between an upper position at which the lid is vertically displaced from the bed and a lower position at which the lid is juxtaposed next to the bed;

a pair of hydraulic cylinders mounted for moving the lid between its upper and lower positions.

5. The indoor vehicle recycling system of claim 4, wherein the means for moving the vehicle into the material press comprising a feed press, the feed press comprising:

a base;

a generally horizontal bed which is sized to receive a vehicle, the bed being mounted for movement relative to the base between a retracted position at which the bed is laterally displaced from the material press means and a extended position at which the bed of the feed press bed overlies and is supported from below by the bed of the material press; and a hydraulic cylinder mounted for moving the bed of the feed press between its retracted and extended positions.

6. The indoor vehicle recycling system of claim 4, wherein the means for moving the vehicle into the material press comprising a feed press, the feed press comprising:

a base interposed between the hold-down mechanism and the material press;

a bed supported by the base;

a pusher plate movable across the bed between a retracted position at which it the pusher plate is laterally displaced from the material press and an extended position at which it is adjacent to the press; and a hydraulic cylinder mounted for moving the pusher plate between its extended and retracted position.

7. The vehicle recycling system of claim 1, wherein the hold-down means comprises:

a hold-down table comprising a generally horizontal, elongate bed; and at least one hold-down beam movable relative to the bed between a first or open position where the beam does not interfere as vehicles are being loaded onto and off of the table and a second or closed position at which the beam is in contact with the upper surface of the of a vehicle located on the table so as to restrict and restrain the vehicle against movement while the engine is being removed via the engine pulling mechanism; and a hydraulic cylinder mounted for moving the hold-down beam between its open and closed positions.

* * * * *